US009947187B2

(12) United States Patent
Brown et al.

(10) Patent No.: US 9,947,187 B2
(45) Date of Patent: Apr. 17, 2018

(54) HAPTIC NOTIFICATION SYSTEM WITH RULES FOR NOTIFICATION THAT CAN BE ALTERED TO INCREASE EFFECTIVENESS

(71) Applicant: International Business Machines Corporation, Armonk, NY (US)

(72) Inventors: Michael Sean Brown, Wahroonga (AU); Tania Ezra, Isaacs (AU); Stefan Harrer, Hampton (AU); Christopher J. Pavlovski, Lower Beechmont (AU); Laurence J. Plant, North Balwyn (AU)

(73) Assignee: International Business Machines Corporation, Armonk, NY (US)

( * ) Notice: Subject to any disclaimer, the term of this patent is extended or adjusted under 35 U.S.C. 154(b) by 21 days.

(21) Appl. No.: 15/417,786

(22) Filed: Jan. 27, 2017

(65) Prior Publication Data

US 2017/0200353 A1 Jul. 13, 2017

Related U.S. Application Data

(63) Continuation-in-part of application No. 14/990,134, filed on Jan. 7, 2016, now abandoned.

(51) Int. Cl.
*G08B 21/00* (2006.01)
*G08B 6/00* (2006.01)

(52) U.S. Cl.
CPC ..... *G08B 6/00* (2013.01)

(58) Field of Classification Search
CPC ..... G08B 6/00
USPC ..... 340/407.1, 407.2
See application file for complete search history.

(56) References Cited

U.S. PATENT DOCUMENTS

| | | | |
|---|---|---|---|
| 6,218,958 | B1 | 4/2001 | Eichstaedt et al. |
| 6,326,901 | B1 | 12/2001 | Gonzales |
| 8,552,847 | B1 | 10/2013 | Hill |
| 2014/0125467 | A1 | 5/2014 | Da Costa et al. |
| 2014/0225718 | A1 | 8/2014 | Fadell et al. |
| 2014/0306812 | A1 | 10/2014 | Yu et al. |

FOREIGN PATENT DOCUMENTS

WO 9303468 A1 2/1993

OTHER PUBLICATIONS

Final Office Action for U.S. Appl. No. 14/990,134 dated Nov. 3, 2016; Pages.
Non Final Office Action for U.S. Appl. No. 14/990,134 dated May 19, 2016; Pages.

*Primary Examiner* — Jeffery Hofsass
(74) *Attorney, Agent, or Firm* — Hoffman Warnick LLC

(57) ABSTRACT

A system, method and program product for delivering haptic notifications to a user. A system is disclosed having: a plurality of wearable devices adapted to be worn on different parts of a user, wherein each wearable device is adapted to output a configurable haptic notification to the user; a host device that coordinates with at least two wearable devices to output a scheme of haptic notifications based on an associated rule in response to a detected event; and a learning system that analyzes feedback from the user to determine an efficacy of the scheme and causes the associated rule to be altered in response to the scheme being deemed ineffective.

20 Claims, 7 Drawing Sheets

HAPTIC NOTIFICATION SYSTEM WITH RULES FOR NOTIFICATION THAT CAN BE ALTERED TO INCREASE EFFECTIVENESS

PRIORITY

This CIP application claims priority to co-pending U.S. application Ser. No. 14/990,134, filed on Jan. 7, 2016, entitled ENHANCED HAPTIC NOTIFICATIONS, the content of which is hereby incorporated by reference.

TECHNICAL FIELD

The subject matter of this invention relates to wearable devices, and more particularly to a wearable device that provides enhanced haptic notifications.

BACKGROUND

Today, smartphones and other mobile devices are fully integrated into many people's lives. An increasing trend is to augment these powerful computing devices with wearable devices such as smart watches, sensors such as fitness bands, heart rate monitors, etc. Wearable devices provide greater convenience, e.g., it is much easier to glance at a watch on your wrist rather than to retrieve a smartphone out of your pocket or bag. Accordingly, wearable devices allow for quicker and more discrete notifications and interactions.

Using wireless technology, smartphones act as gateways, relaying messages to wearable devices, thus allowing users to interact with something being worn rather than their smartphone to, e.g., read an incoming message. Today, smartwatches can notify the user via a sound, vibration or notification on the screen regarding, e.g., a new text message, email, etc. The use of a vibration is often preferable in that it cannot be heard or seen by others, which avoids being socially or physically distracting.

Currently however, vibration-based notifications are limited to simple haptic alerts. As such, it is impossible to convey in depth information without the user viewing or otherwise interrogating the wearable device or smartphone, e.g., vibrations cannot be utilized to convey whether the notification is important or who it is from. Thus, e.g., there is no means for a text message to be relayed to a user without the user looking at their display or listening to the message being broadcast via speech synthesis.

SUMMARY

Aspects of the disclosure provide a wearable device and associated infrastructure that utilizes a programmable haptic interface for generating haptic signal patterns to the user. In one embodiment, the haptic interface includes a grid of tactile teeth that move independently against the wearer's skin to allow for situational notifications, while maintaining a discrete and silent communication between the device and the wearer.

The haptic interface may be programmable and configurable based on a type of received triggering event, thus, e.g., enabling urgent messages, messages from specific people, or specific applications to have their own patterns.

A first aspect provides a wearable device having a haptic notification system, comprising: a system for receiving triggering events from a host device; a multi-node haptic interface capable of generating distinguishable haptic signal patterns; and a system for instructing the multi-node haptic interface to output a predetermined haptic signal pattern in response to a received triggering event.

A second aspect provides a multi-node haptic interface, comprising: a plurality of output nodes arranged in a pattern, each output node capable of being activated to generate a haptic signal; and a controller that causes a selectable set of the output nodes to be activated to generate a haptic signal pattern.

A third aspect provides a notification infrastructure, comprising: a host device; and a haptic notification system incorporated into a wearable device, comprising: a system for receiving a triggering event from the host device; a multi-node haptic interface capable of generating distinguishable haptic signal patterns; and a system for instructing the multi-node haptic interface to output a predetermined haptic signal pattern in response to a received triggering event.

A fourth aspect provides a system for delivering haptic notifications to a user, comprising: a plurality of wearable devices adapted to be worn on different parts of a user, wherein each wearable device is adapted to output a configurable haptic notification to the user; a host device that coordinates with at least two wearable devices to output a scheme of haptic notifications based on an associated rule in response to a detected event; and a learning system that analyzes feedback from the user to determine an efficacy of the scheme and causes the associated rule to be altered in response to the scheme being deemed ineffective.

A fifth aspect provides a computer program product stored on a computer readable storage medium, which when executed by a computing system, generates notifications to multiple wearable devices, comprising: program code that detects events on a host device; program code that coordinates with at least two wearable devices to output a scheme of notifications based on an associated rule for a detected event; program code that collects feedback from a user utilizing the wearable devices; and program code that analyzes the feedback to determine an efficacy of the scheme and causes the associated rule to be altered in response to the scheme being deemed ineffective.

A sixth aspect provides a method for generating notifications to multiple wearable devices, comprising: detecting an event on a host device; coordinating with at least two wearable devices to output a scheme of notifications based on an associated rule for a detected event; collecting feedback from a user utilizing the wearable devices; analyzing the feedback to determine an efficacy of the scheme; and causing the associated rule to be altered in response to the scheme being deemed ineffective.

BRIEF DESCRIPTION OF THE DRAWINGS

These and other features of this invention will be more readily understood from the following detailed description of the various aspects of the invention taken in conjunction with the accompanying drawings in which.

Figure 1:
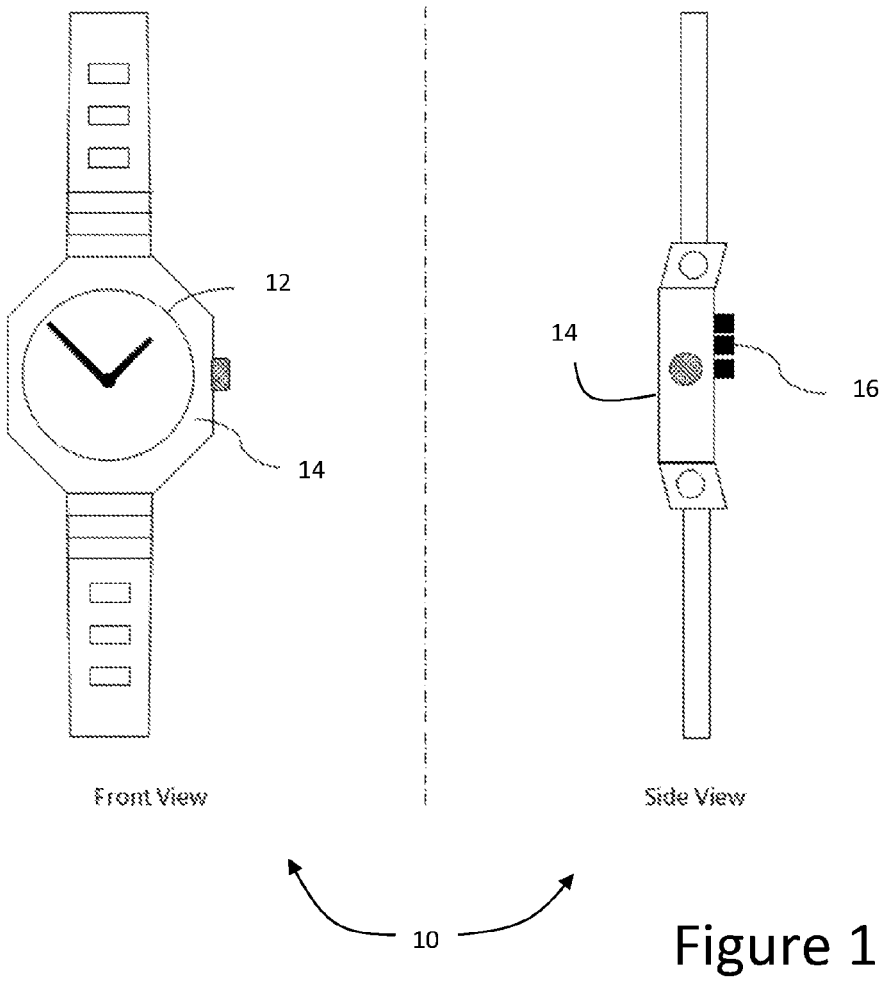
FIG. 1 shows a smartwatch having a multi-node haptic interface according to embodiments.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Referring now to the drawings, FIG. 1 depicts a front view and a side view of a wearable device, in this example a smartwatch 10, which includes a haptic notification system 16. Smartwatch 10 may for example include features found on smartwatches such the APPLE WATCH®, including a display area 12 and a body 14 that includes electronics, such a processor, memory, input/output, etc. In this illustrative embodiment, however, smartwatch 10 includes haptic notification system 16 capable of generating notifications in the form of distinguishable haptic signals. Distinguishable haptic signals are achieved with a multi-node haptic interface that can output different signal patterns in response to a triggering event. A triggering event may for example include a received text message, phone call, message from an App, etc., that is pushed from a remote host, such as a smartphone.

Figure 2:
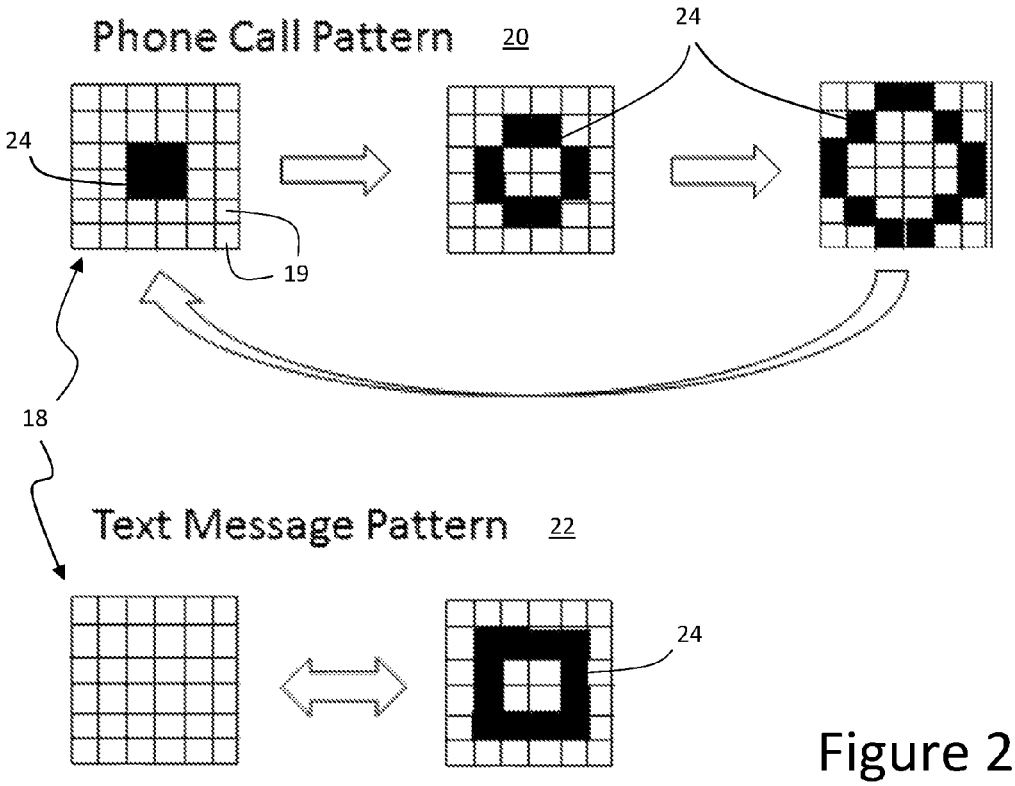
FIG. 2 shows haptic patterns according to embodiments.
Figure 3:
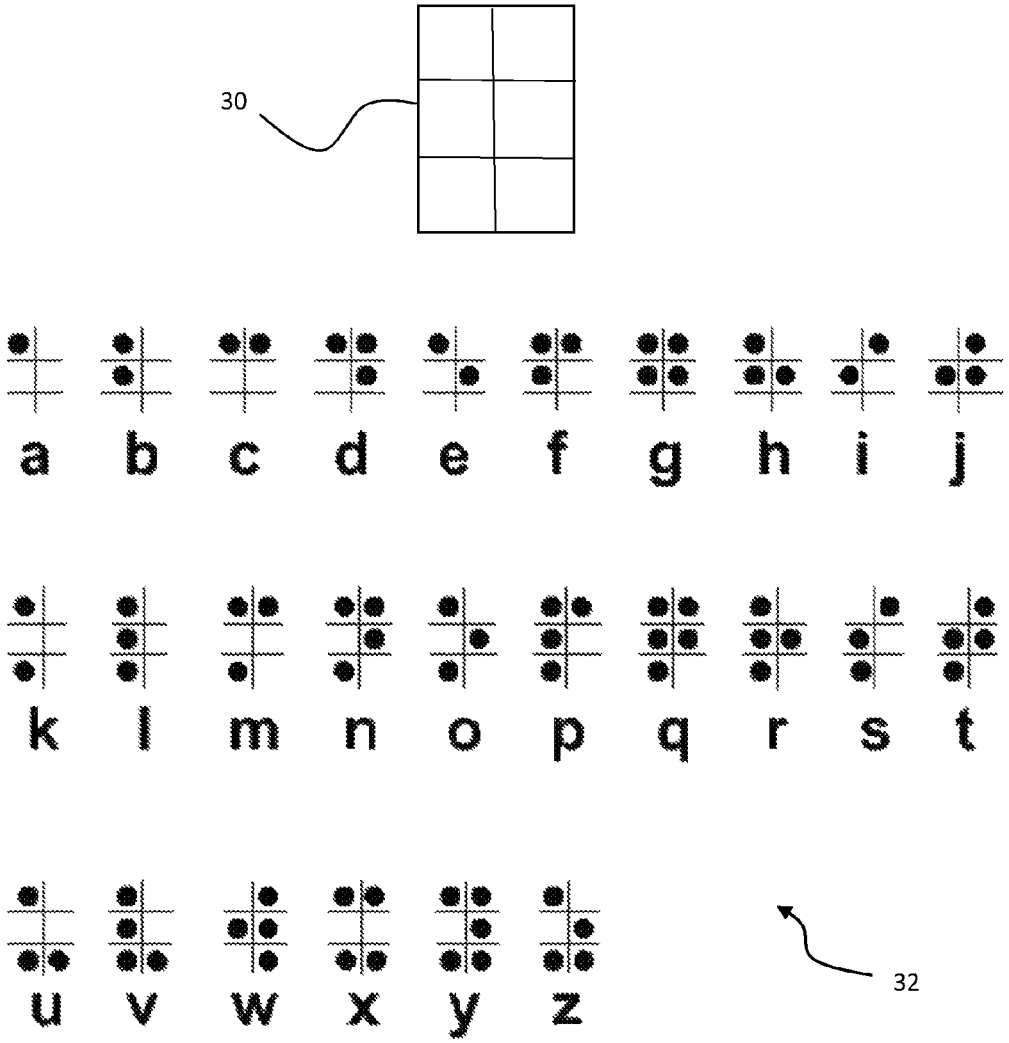
FIG. 3 shows a grid for displaying haptic patterns associated with the alphabet according to embodiments.

FIG. 2 depicts a multi-node haptic interface 18 implemented as a 6×6 grid of output nodes. Each output node in the grid is individually controllable to generate a haptic signal. Combinations of output nodes can be controlled to generate a haptic signal pattern 20, 22. The two examples shown depict an illustrative phone call pattern 20 and text message pattern 22. Blackened output nodes 24 indicate a predefined output signal pattern being generated. As can be seen, in the depicted phone call pattern 20, a sequence of three different signal patterns are repeatedly generated over a period of time (e.g., to simulate an expanding circular beacon). In the depicted text message pattern 22, a simple square signal pattern is toggled on and off over a period of time. Obviously, any number interface layouts, patterns, sequences etc., may be generated to convey information to the user. FIG. 3 for example depicts a haptic interface 30 having a 2×3 grid capable of generating a plurality of different signal patterns, which in this case, corresponds to letters 32 in the alphabet.

Although shown as grid patterns in the illustrative embodiments described herein, it is understood that the multi-node interface may utilize any configuration, e.g., a circular configuration, a cross configuration, etc.

Figure 4:
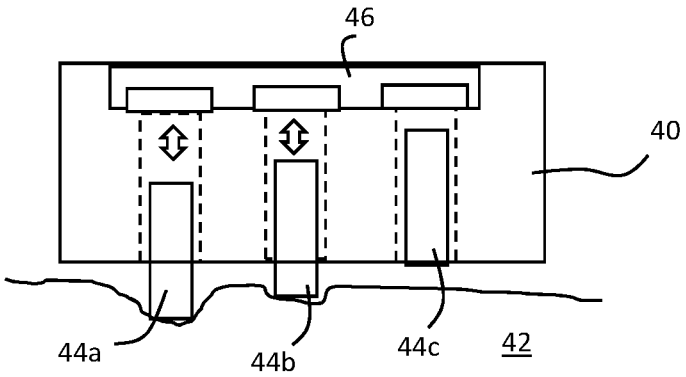
FIG. 4 shows a mechanical multi-node haptic interface according to embodiments.
Figure 5:
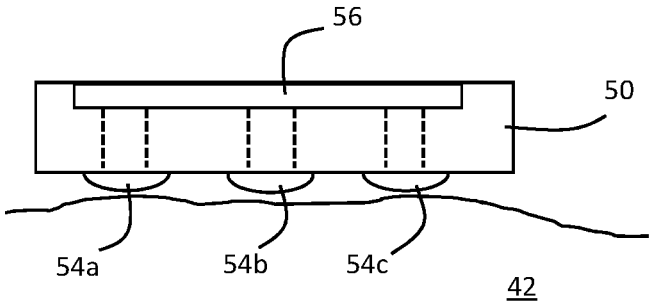
FIG. 5 shows a non-mechanical multi-node haptic interface according to embodiments.

FIGS. 4 and 5 depict side-views of two illustrative multi-node haptic interfaces 40, 50, respectively. Multi-node haptic interface 40 of FIG. 4 shows a mechanical embodiment that utilizes a set of movable tactile "teeth" 44*a*, 44*b*, 44*c* as output nodes to create different haptic signal patterns against a user's skin 42. In the depicted example, a controller 46 causes teeth 44*a*, 44*b*, 44*c* to be extended and retracted to create a desired haptic signal pattern. Any mechanism may be utilized to create the necessary movement, including an electro-mechanical system, a piezo-electrical based system, an electromagnetic system, etc. Note in this example, teeth 44*a*, 44*b*, 44*c*, may be extended at different depths (i.e., intensities) to provide for additional signal patterns. In the arrangement shown, each tooth is capable of being placed in three positions. Tooth 44*a* is fully extended, tooth 44*b* is half extended, and tooth 44*c* is fully retracted. Thus, multi-node haptic interface 40 may be implemented with up to three degrees of information, e.g., an x-y grid (as shown in FIGS. 2-3) and z depth or intensity.

FIG. 5 depicts a non-mechanical multi-node haptic interface 50 that relies for example on heat, an electrical charge, air movement, etc. In this case, the output nodes comprise probes (e.g., electrodes, LED devices, heat exchangers, etc.) 54*a*, 54*b*, 54*c* that are utilized to generate non-mechanical signals to the user's skin 42. As with the example of FIG. 4, controller 56 may be configured to generate different signal intensities (e.g., off, warm, hot) at probes 54*a*, 54*b*, 54*c* to convey up to three degrees of information to the user.

Note that the particular haptic implementation may depend on the nerve endings at a given location on the body. For example, for the back of a person's wrist, mechanical teeth may be suitable to represent different alert states for the host device. For more sensitive areas such as fingertips, a finer encoding method may be employed, e.g., pins.

As noted, the multi-node haptic interface can be mechanical, temperature based (e.g., thermal LEDs), electrically based (e.g., static electricity), etc. The haptic interface can contact with a user's skin anywhere on the user's body, e.g.: on the back of a watch or via any other wearable device worn in direct contact with the skin, including but not limited to a belt, necklace, head band, bra strap, etc. In addition, the haptic interface may be accessible through a flip interface on a watch or smart device (i.e., the user accesses the message by raising or flipping the watch display to access the haptic display area); in which the user runs their finger across the device to access the haptic display area; etc.

Figure 6:
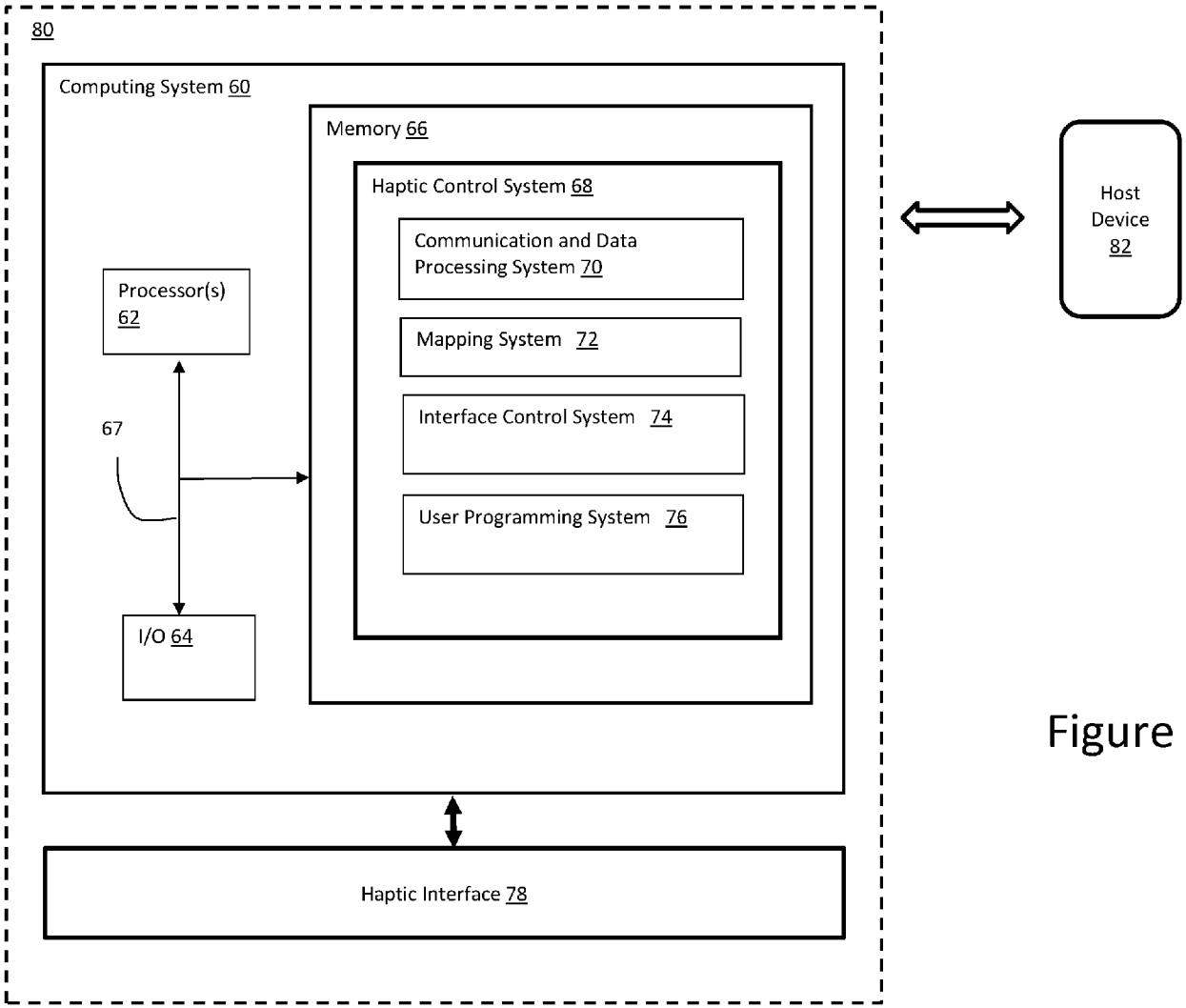
FIG. 6 shows a computing system having a haptic control system according to embodiments.

FIG. 6 depicts a notification infrastructure having an illustrative haptic notification system 80 that operates in conjunction (e.g., wirelessly) with a host device (i.e., host) 82, such as a smartphone or other smart appliance. Haptic notification system 80 generally includes a computing system 60 and a multi-node haptic interface 78, and can be implemented in a smartwatch or any other wearable device that is in contact with a user's skin, e.g., clothing, shoes, jewelry, fashion accessories, etc. Computing system 60 as shown includes a haptic control system 68 having a communication and data processing system 70 for sending and receiving data to and from the host device 80, e.g., phone call, texting or other application data. Communication and data processing system 70 also receives and analyzes information to identify triggering events for which haptic outputs should be generated. For instance, text messages, phone calls, notifications from Apps, etc., may be identified as types of triggering events. Communication and data processing system 70 may also capture associated information such as an identification of the sender, a priority, an importance, App name, etc.

Once a triggering event is identified and parsed, mapping system 72 performs a mapping operation, such as a table look-up, database query, etc., to determine an associated haptic response based on the triggering event and associated information. For instance, a text from an important sender may be assigned a first response; a text from a non-important sender may be assigned a second response, a phone call may be assigned a third response, etc. Once determined, interface control system 74 communicates the appropriate control instructions to the multi-node haptic interface 78 to cause a predetermined haptic signal pattern to be generated to the user's skin. A user programming system 76 may be employed to allow the user to assign haptic signal patterns (i.e., notifications) to different triggering events.

Figure 7:
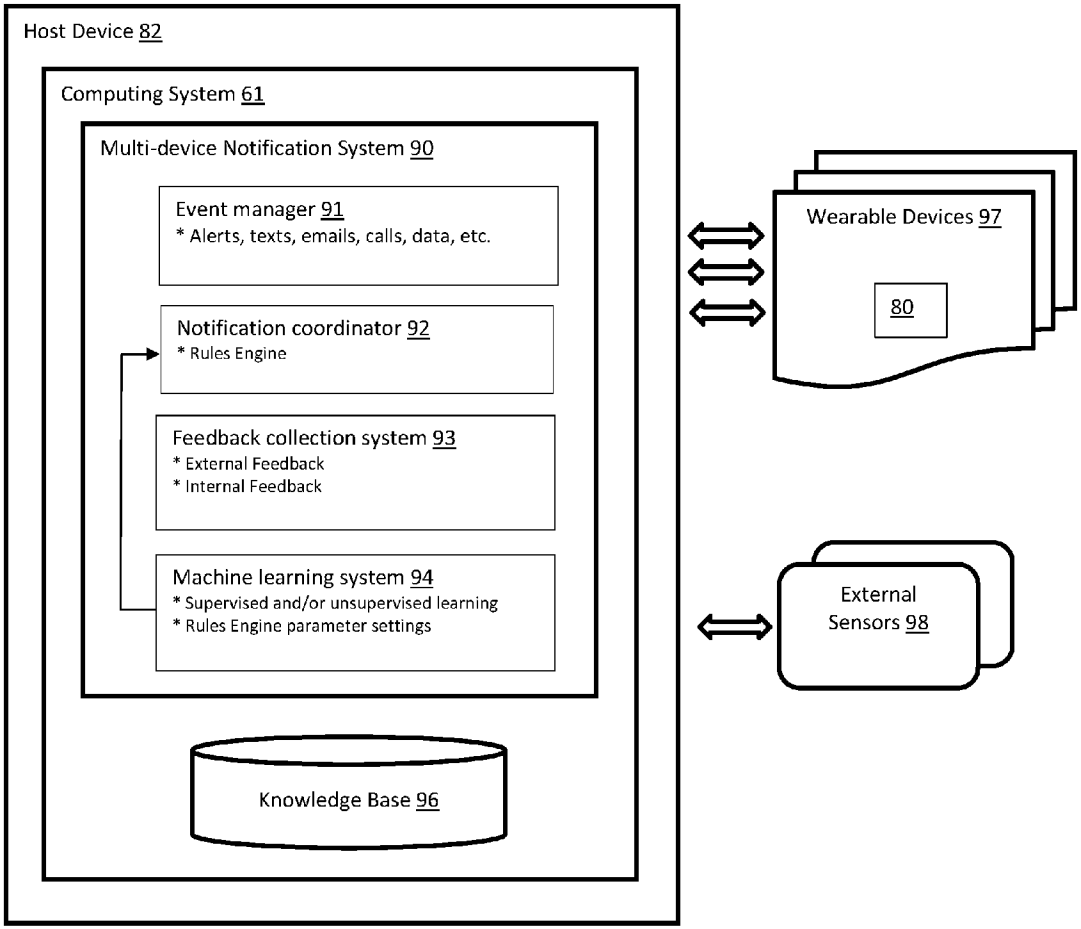
FIG. 7 depicts a host device having a multi-device notification system according to embodiments.

FIG. 7 depicts a further embodiment in which host device 82 is adapted to control and interact with multiple wearable devices 97 in a coordinated manner. As noted, host device 82 may for example comprise a smart phone, smart appliance, or any other device capable of employing a computing system 61, within which a multi-device notification system 90 can be run. As described in further detail herein, multi-device notification system 90 coordinates the issuing of a notification scheme involving multiple wearable devices 97. For example, a user may receive a first haptic notification on piece of smart clothing indicating that a text message was received, and then receive an encoded haptic message on a wrist watch with the actual text message. Any notification mechanism be utilized, e.g., vibrating, thermal, electrical, visual, aural, etc.

To implement such features, multi-device notification system 90 includes an event manager 91 that detects, manages and processes events, such as alerts, texts, emails, calls, data, etc. For example, host device 82 may comprise a smart phone that: obtains a traffic alert on a navigation application running on the smart phone; receives a text message from a family member; obtains navigation information from a mapping application; receives an inbound phone call, etc. Once an event is detected, event manager 91 determines the type of event and any relevant metadata associated with the event (e.g., time it was generated, who/where it came from, level of importance, etc.). The event information is then forwarded to a notification coordinator 92, which communicates a set of event based notifications (i.e., based on a notification scheme) to a plurality of wearable devices 97. The event based notifications may be sent in parallel to multiple wearable devices 97 simultaneously, or sequentially (e.g., based on time, a user response, a third party input, etc.). For example, a smart watch may vibrate indicating some type of alert condition exists, and in response to a shaking of the user's wrist, a pair of smart glasses may display a weather warning. The particular notification scheme, and associated wearable devices 97 (i.e., nodes) utilized to convey information to the user may be determined by a rules engine in the notification coordinator 92. For example, the rules engine may determine that for a text message from a family member, the information will be conveyed with an initial haptic signal in a piece of smart clothing, followed by an encoded haptic message generated from a smart watch. For weather alerts while driving, the notification scheme may involve a vibration in a smart watch, followed by a display in smart glasses.

In addition, as part of the notification process, feedback collection system 93 will collect feedback, e.g., from external sensors 98, the wearable devices 97, and/or the host device 82 itself. Feedback may for example include: the time it took for a user to respond to a notification; how the user responded to a notification; body temperature changes; user reactions; whether the notifications had to be repeated; etc. The associated notifications and feedback information may be stored in knowledge base 96, where machine learning system 94 may be employed to analyze the information and alter the settings of rules engine parameters as needed. For example, if the machine learning system 94 determines that the user typically does not respond appropriately to a particular notification scheme, then the associated rule may be altered to change the notification scheme achieve better results.

Machine learning system 94 may for example utilize a neural network, clustering, or other technique to adjust notification schemes based on feedback. Adjustments may be done using supervised learning during a training mode or unsupervised learning during actual use. Learning may for example be based on whether the notification scheme provided a good result, an acceptable result or an unacceptable result. Thus for example, if an unacceptable result was detected (e.g., the user did not respond to a critical text when prompted), the machine learning system 94 could alter the notification scheme for future instances. Body temperature and other similar sensor readings may be utilized to biologically measure a user response, e.g., anxiety, like or dislike, etc.

Figure 8:
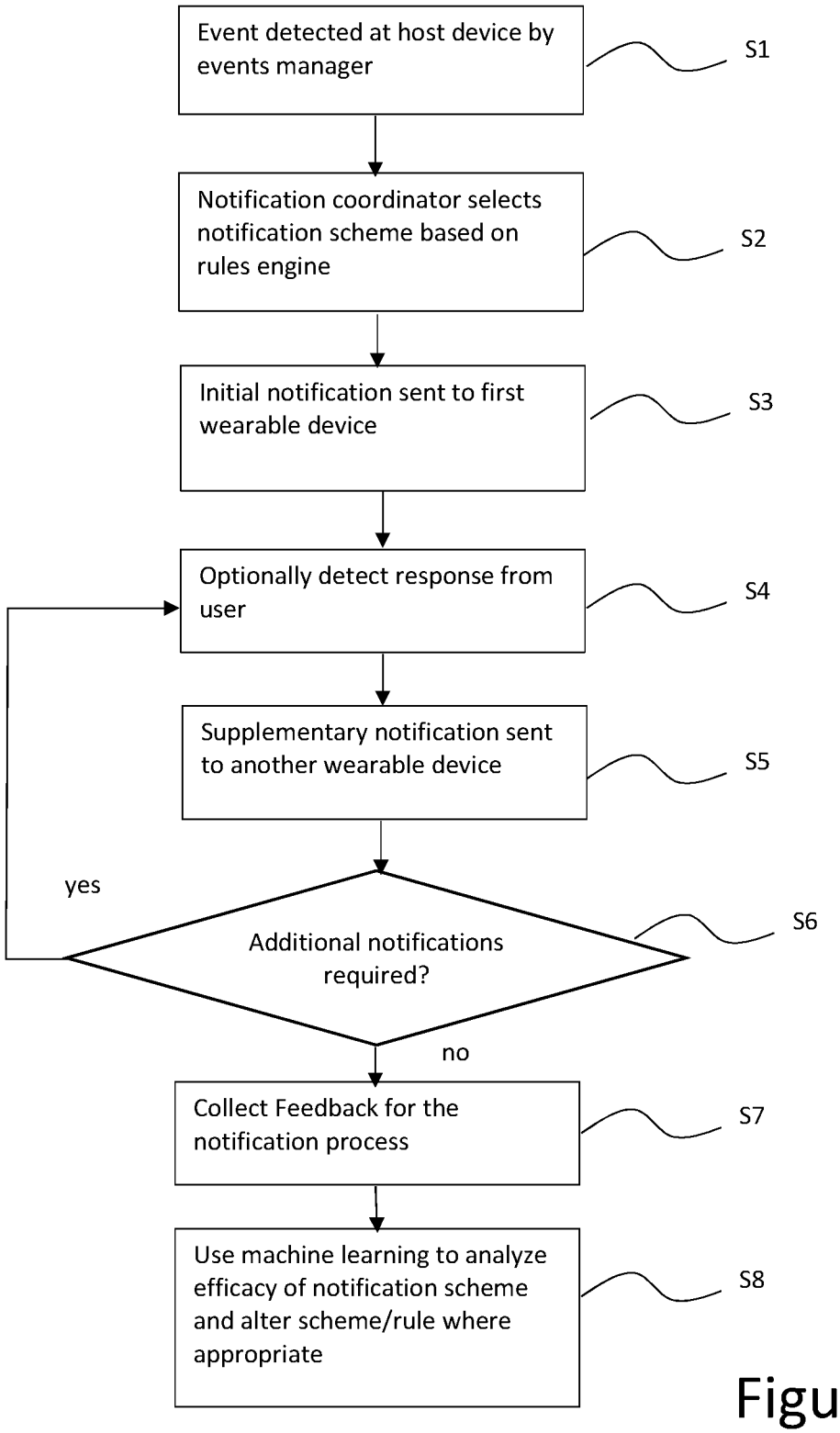
FIG. 8 depicts a flow diagram showing a method of implementing the multi-device notification system of FIG. 7.

FIG. 8 depicts an illustrative process for implementing a multi-device notification system 90 as depicted in FIG. 7. At S1, the events manager 91 detects an event at the host device 82 and at S2, the notification coordinator 92 selects an appropriate notification scheme based on the rules engine. At S3, an initial notification is sent to a first wearable device 97 and at S4, a response is (optionally) detected from the user (e.g., the user shakes their wrist, utters a word, etc.). Once detected, a supplementary notification is sent to another wearable device 97 at S5. At S6, a determination is made whether further notifications are required as part of the scheme, and if so (yes, S6) functionality returns to S4. If not (no, S6), feedback associated with the notification process is collected at S7 and at S8, machine learning us used to analyze the efficacy of the notification scheme. If necessary, the associated scheme/rule is altered.

It is understood that haptic control system 68 and/or multi-device notification system 90 may be implemented as a computer program product stored on a computer readable storage medium. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Python, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Computing system 60 (and similarly computing system 61) that may comprise any type of computing device and for example includes at least one processor 62, memory 66, an input/output (I/O) 64 (e.g., one or more I/O interfaces and/or devices), and a communications pathway 67. In general, processor(s) 62 execute program code which is at least partially fixed in memory 66. While executing program code, processor(s) 62 can process data, which can result in reading and/or writing transformed data from/to memory and/or I/O 64 for further processing. The pathway 67 provides a communications link between each of the components in computing system 60. I/O 64 can comprise one or more human I/O devices, which enable a user to interact with computing system 60.

Furthermore, it is understood that the haptic control system 68 or relevant components thereof (such as an API component, agents, etc.) may also be automatically or semi-automatically deployed into a computer system by sending the components to a central server or a group of central servers. The components are then downloaded into a target computer that will execute the components. The components are then either detached to a directory or loaded into a directory that executes a program that detaches the components into a directory. Another alternative is to send the components directly to a directory on a client computer hard drive. When there are proxy servers, the process will select the proxy server code, determine on which computers to place the proxy servers' code, transmit the proxy server code, then install the proxy server code on the proxy computer. The components will be transmitted to the proxy server and then it will be stored on the proxy server.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A system for delivering haptic notifications to a user, comprising:

a plurality of wearable devices adapted to be worn on different parts of a user, wherein each wearable device is adapted to output a configurable haptic notification to the user;

a host device that coordinates with at least two wearable devices to output a scheme of haptic notifications based on an associated rule in response to a detected event; and a learning system that analyzes feedback from the user to determine an efficacy of the scheme and causes the associated rule to be altered in response to the scheme being deemed ineffective.

2. The system of claim 1, wherein a first wearable device generates a haptic signal indicating that a message has been received, and a second wearable device outputs the message.

3. The system of claim 1, wherein the learning system utilizes a body temperature as feedback for the learning system.

4. The system of claim 1, wherein the feedback includes whether the user responded to the scheme.

5. The system of claim 1, wherein the feedback includes how quickly the user responded to at least one haptic notification.

6. The system of claim 1, wherein a first wearable device is adapted to output a mechanical haptic signal and a second wearable device is adapted to output a thermal haptic signal.

7. The system of claim 1, wherein at least one wearable device includes a mechanism to control playback of a message.

8. A computer program product stored on a computer readable non-transitory storage medium, which when executed by a computing system, generates notifications to multiple wearable devices, comprising:

program code that detects events on a host device;

program code that coordinates with at least two wearable devices to output a scheme of notifications based on an associated rule for a detected event;

program code that collects feedback from a user utilizing the wearable devices; and program code that analyzes the feedback to determine an efficacy of the scheme and causes the associated rule to be altered in response to the scheme being deemed ineffective.

9. The program product of claim 8, wherein the scheme causes a haptic signal to be generated at a first wearable device indicating that a message has been received, and subsequently causes a message to be outputted at a second wearable device.

10. The program product of claim 8, wherein the learning system utilizes a body temperature as feedback for the learning system.

11. The program product of claim 8, wherein the feedback includes whether the user responded to the scheme.

12. The program product of claim 8, wherein the feedback includes how quickly the user responded to at least one haptic notification.

13. The program product of claim 8, wherein a first wearable device is adapted to output a mechanical haptic signal and a second wearable device is adapted to output a thermal haptic signal.

14. The program product of claim 8, wherein at least one wearable device includes a mechanism to control playback of a message.

15. A method for generating notifications to multiple wearable devices, comprising:

detecting an event on a host device;

coordinating with at least two wearable devices to output a scheme of notifications based on an associated rule for a detected event;

collecting feedback from a user utilizing the wearable devices;

analyzing the feedback to determine an efficacy of the scheme; and causing the associated rule to be altered in response to the scheme being deemed ineffective.

16. The method of claim 15, wherein the scheme causes a haptic signal to be generated at a first wearable device indicating that a message has been received, and subsequently causes a message to be outputted at a second wearable device.

17. The method of claim 15, wherein the learning system utilizes a body temperature as feedback.

18. The method of claim 15, wherein the feedback includes whether the user responded to the scheme.

19. The method of claim 15, wherein the feedback includes how quickly the user responded to at least one haptic notification.

20. The method of claim 15, wherein a first wearable device is adapted to output a mechanical haptic signal and a second wearable device is adapted to output a thermal haptic signal.

* * * * *